US008424469B2

(12) United States Patent
Shuert

(10) Patent No.: US 8,424,469 B2
(45) Date of Patent: Apr. 23, 2013

(54) PLASTIC PALLET WITH TWIN-SHEET DECK AND RUNNER STRUCTURES

(75) Inventor: Lyle Shuert, Bloomfield Hills, MI (US)

(73) Assignee: Shuert Technology LLC, Sterling Heights, MI (US)

( * ) Notice: Subject to any disclaimer, the term of this patent is extended or adjusted under 35 U.S.C. 154(b) by 49 days.

(21) Appl. No.: 13/043,774

(22) Filed: Mar. 9, 2011

(65) Prior Publication Data

US 2012/0227640 A1 Sep. 13, 2012

(51) Int. Cl.
*B65D 19/38* (2006.01)

(52) U.S. Cl.
USPC ..... 108/57.27; 108/57.28

(58) Field of Classification Search ..... 108/51.11, 108/57.25–57.28
See application file for complete search history.

(56) References Cited

U.S. PATENT DOCUMENTS

| | | | | |
|---|---|---|---|---|
| 4,606,278 | A | 8/1986 | Shuert | |
| 4,735,154 | A * | 4/1988 | Hemery | 108/56.1 |
| 5,042,396 | A | 8/1991 | Shuert | |
| 5,117,762 | A * | 6/1992 | Shuert | 108/57.25 |
| 5,197,396 | A | 3/1993 | Breezer et al. | |
| 5,391,251 | A | 2/1995 | Shuert | |
| 5,404,829 | A | 4/1995 | Shuert | |
| 5,413,052 | A * | 5/1995 | Breezer et al. | 108/56.1 |
| 5,596,933 | A * | 1/1997 | Knight et al. | 108/57.27 |
| 7,216,415 | B2 * | 5/2007 | Hentges et al. | 29/557 |
| 7,343,865 | B2 | 3/2008 | Shuert | |
| 2003/0075082 | A1 | 4/2003 | Apps | |
| 2004/0159267 | A1 * | 8/2004 | Markling et al. | 108/57.25 |
| 2004/0168618 | A1 * | 9/2004 | Muirhead | 108/57.25 |
| 2006/0075939 | A1 * | 4/2006 | Shuert | 108/57.25 |
| 2011/0174198 | A1 * | 7/2011 | Seger | 108/57.27 |

* cited by examiner

*Primary Examiner* — Janet M Wilkens
*Assistant Examiner* — Timothy M Ayres
(74) *Attorney, Agent, or Firm* — Young Basile Hanlon & MacFarlane PC

(57) ABSTRACT

A reinforced plastic pallet comprises a twin sheet deck structure and three twin sheet runner structures which are fused to the underside of the deck to create three parallel spaced-apart footprints, the spacing between them forming one set of forklift openings. The deck is fabricated from two thermoformed plastic sheets which are peripherally joined together. The lower sheet is formed with upwardly extending spacer knobs which are fused to the under surface of the top sheet to further join the two sheets together. A frame of reinforcing beams is encapsulated into the interior space of the upper deck. The runner structures are also of twin sheet construction and some of them contain reinforcing rods. The runner structures, although they have flat footprints, are generally "W" shaped to provide two additional forklift openings at 90° from the primary forklift openings between the runner structures.

21 Claims, 9 Drawing Sheets

PLASTIC PALLET WITH TWIN-SHEET DECK AND RUNNER STRUCTURES

FIELD OF THE INVENTION

The invention relates to plastic pallets and more particularly to a light weight, rigid plastic pallet comprising deck and runner structures, all of which are of twin-sheet construction.

BACKGROUND

It is generally known to fabricate industrial pallets from sheets of thermoformable plastic material. In general, once the sheets are extruded, they are thermoformed into the appropriate shape and fused together, sometimes with reinforcing structures between the thermoformed and fused sheets for added rigidity. Examples are illustrated in U.S. Pat. Nos. 5,391,251, 5,043,296 and 5,404,829 wherein the inventor is Lyle H. Shuert, the inventor of the present pallet.

SUMMARY OF THE INVENTION

The present invention is a pallet made primarily of polymeric sheet materials fabricated to provide deck and runner structures, both of which are of at least partly hollow, twin-sheet construction. As such, the pallet exhibits relatively light weight, a high degree of stiffness or rigidity and, for added rigidity, can accommodate reinforcing structures in several locations.

In illustrative embodiments hereinafter described in detail, a pallet which embodies the invention includes a deck structure, having a top load surface, and one or more runner structures attached to the bottom of the deck. The load surface may be fabricated in such a way as to exhibit an enhanced friction characteristic. This can, for example, be accomplished by extruding a layer of a thermoplastic olefin such as Vyran® or Santoprene® onto the plastic which is used to thermoform the components of the pallet. The higher friction quality can also be imparted to areas of the pallet such as the forklift openings. Alternatively, polyethylene surfaces can be brushed to increase friction characteristics.

Further in accordance with are illustrative embodiment hereinafter described in detail, the pallet can provide four-way forklift entry, in one direction by virtue of the spacing between the runner structures and in the orthogonal direction by virtue of the configurations of the runner structures; i.e., the runner structures are separately formed to have a "W" shape which provides not only the necessary forklift openings but strong load bearing structure as well.

The various features and advantages of the present invention will be best understood from a reading from the following specification which is to be taken with the accompanying drawings.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
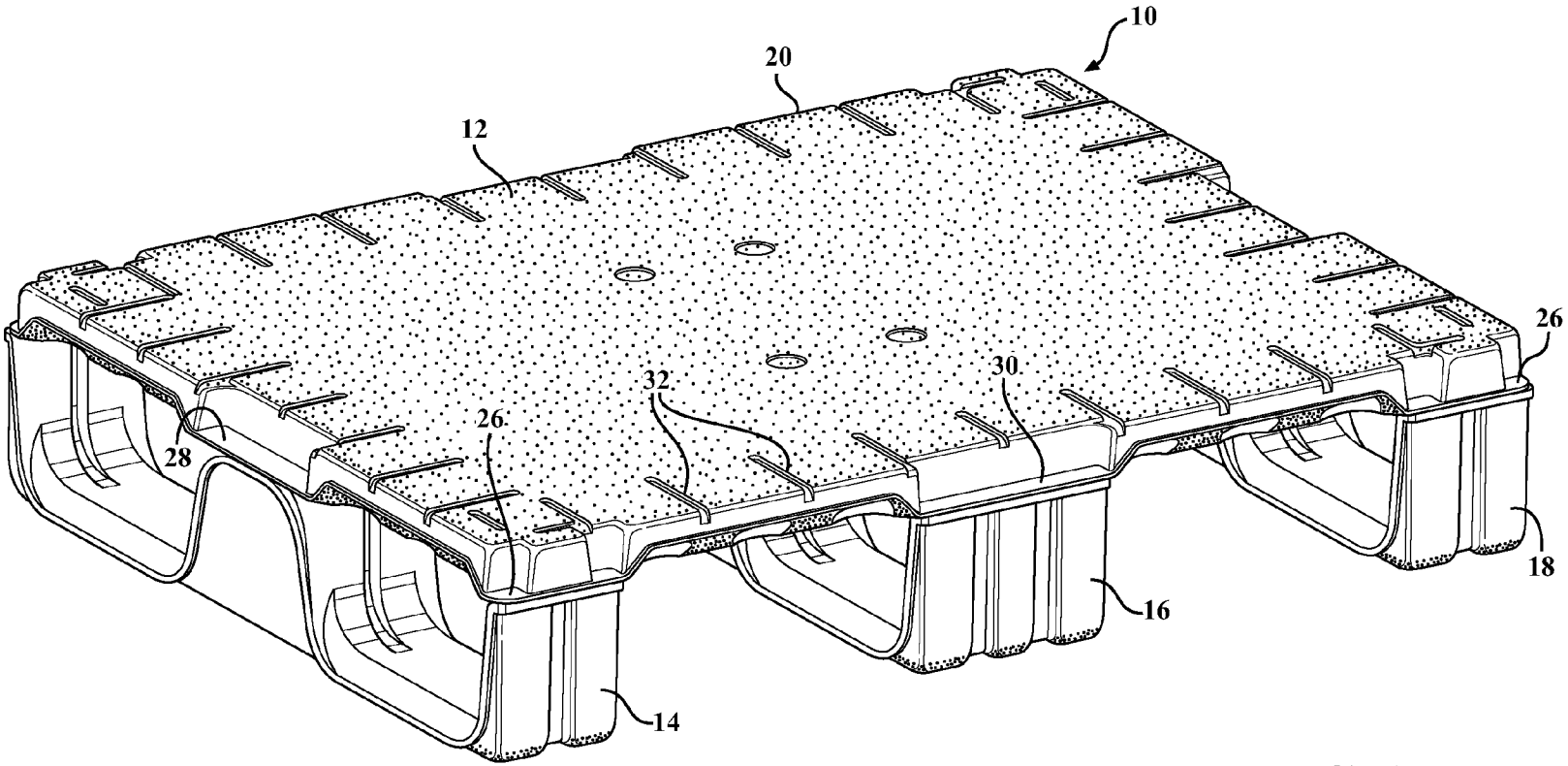
FIG. 1 is a perspective view of a plastic pallet embodying the invention.

Referring to the figures, there is shown a pallet 10 comprising an upper deck structure 12 and three individual runner structures 14, 16, 18 which are formed independently of the deck structure 12 and thereafter fused to the bottom surface of the deck structure 12 to form a unitary pallet structure. The geometric shape of the pallet 10 is essentially rectangular and in a commercial embodiment may be 600 mm by 800 mm. As such, it may function as a "half pallet" wherein two such pallets are placed on top of a master pallet which may be of the same or different structure. These dimensions and use descriptions are merely illustrative as pallets incorporating the present invention may be fabricated in various sizes and shapes and used in various combinations as well as by themselves.

The deck structure 12 comprises a thermoformed plastic top sheet 20 of generally rectangular configuration and a coextensive thermoformed plastic bottom sheet 22, the sheets 20 and 22 having substantially the same overall dimensions but having different surface features as hereinafter described. The top sheet 20 of the deck structure 12 and the bottom sheet 22 of the deck structure 12 are peripherally fused together partly as shown at 24 in FIG. 9. In addition, the top sheet 20 has recessed steps 26 formed at the four corners. Centrally along the short sides of the top sheet 20, there are additional peripheral steps 28. Along the longer sides of the rectangular sides of the rectangular top sheet 20 and halfway between the corner structures 26 are additional peripheral steps 30. These steps provide a number of advantages. First, they create vertical sections which add stiffness. Second, the steps increase the peripheral surface areas where knitting of the top and bottom sheets 20, 22 occurs. Third, they provide pressure bearing areas which are used when deck 12 is joined to the runners.

The steps 26, 28, 30 form peripheral landings which overlie mating peripheral areas of the lower sheet 22 and are knitted to the lower sheet 22 to form a substantially continuous knitting line along the entire periphery of the deck structure 12. Inwardly directed peripheral slots 32 are also formed in the upper sheet 20 of the deck structure 12. These slots provide small vertical beam areas which add stiffness to the deck 12 and help fix a reinforcing beam 40 in position as hereinafter described.

Figure 4:
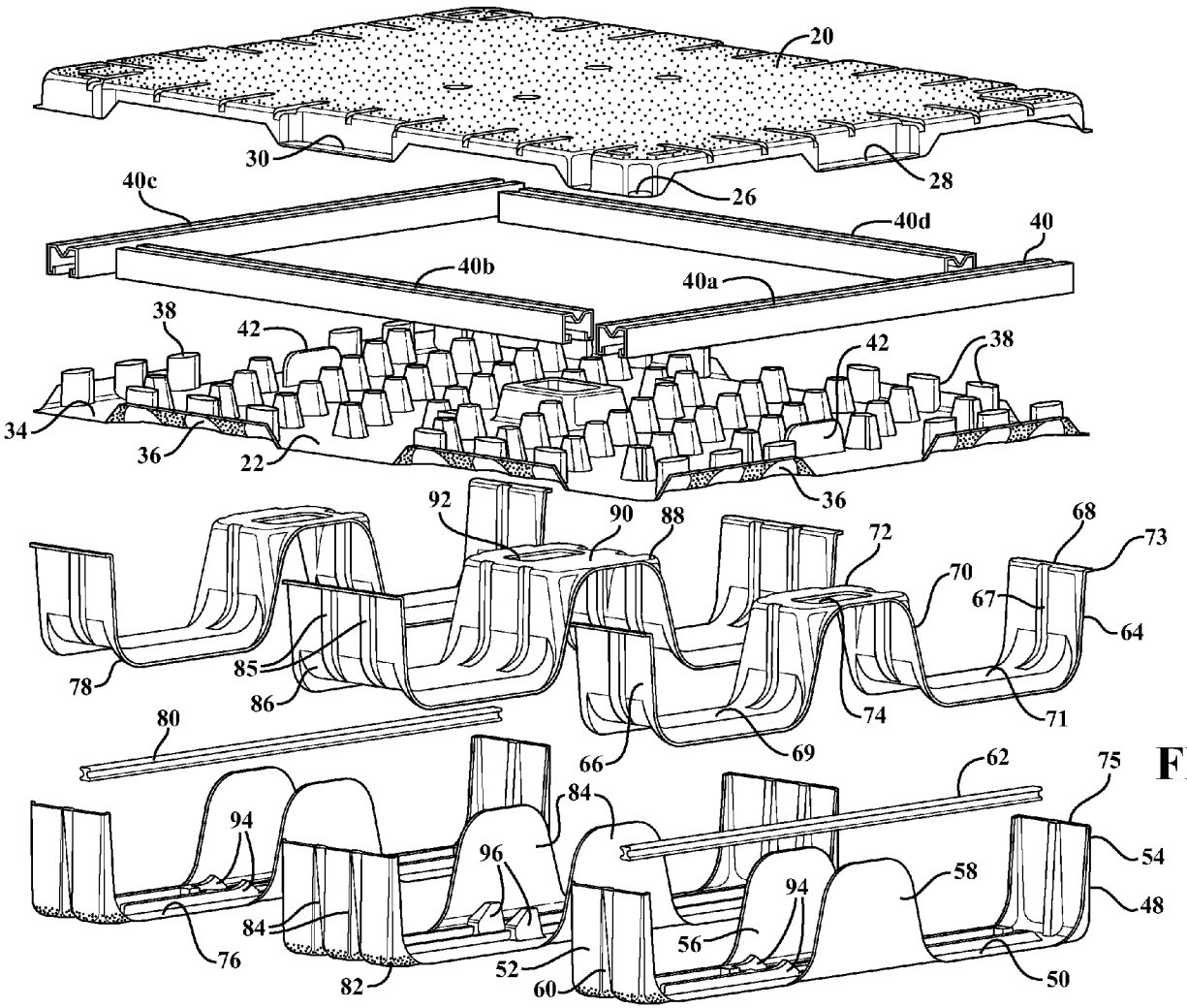
FIG. 4 is an exploded view of the plastic pallet of FIG. 1 illustrating the fact that both the deck and runner structures are of reinforced twin sheet construction.
Figure 5:
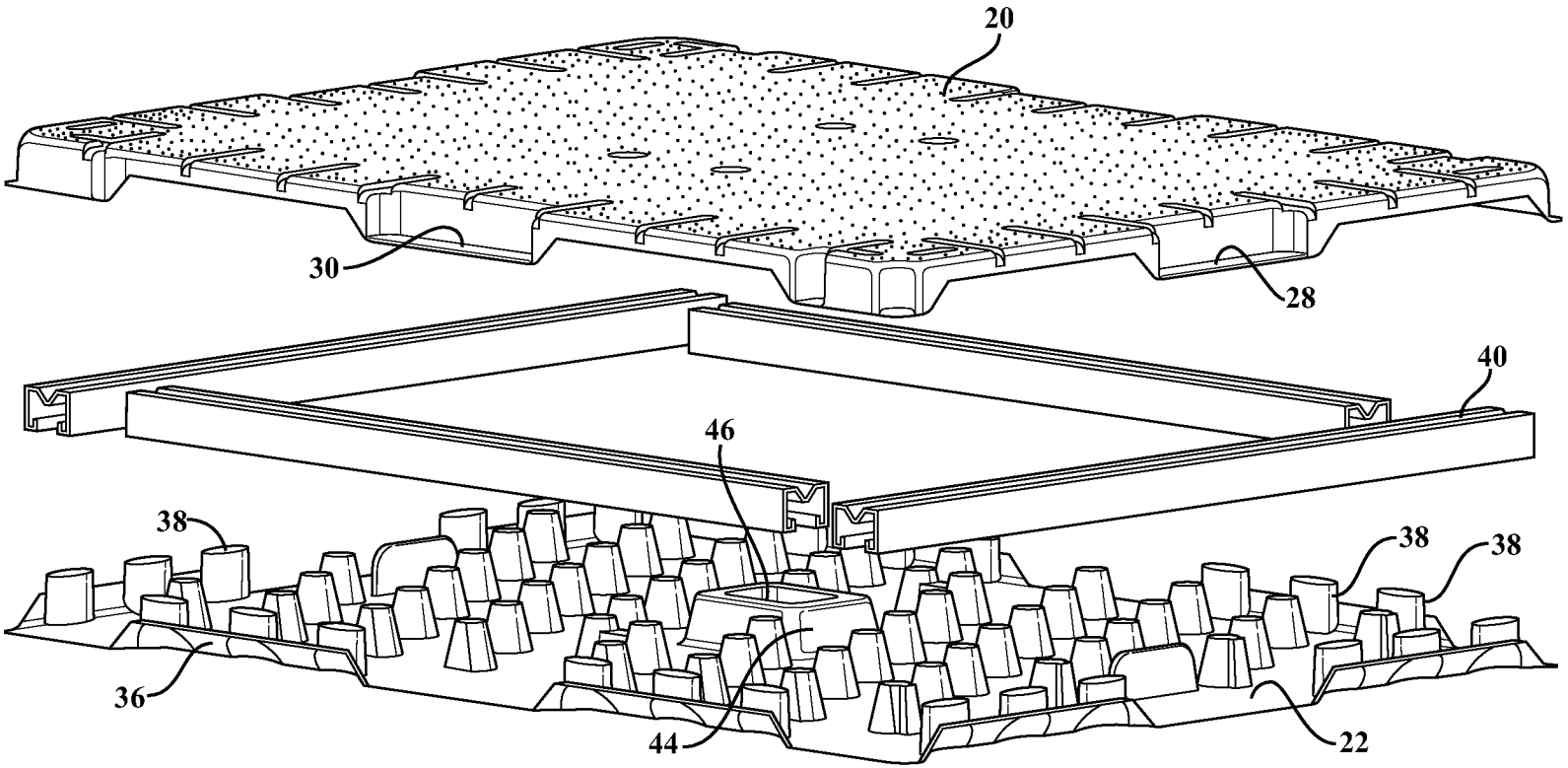
FIG. 5 is a perspective exploded view of the deck structure including a metal reinforcing frame encapsulated therein.
Figure 6:
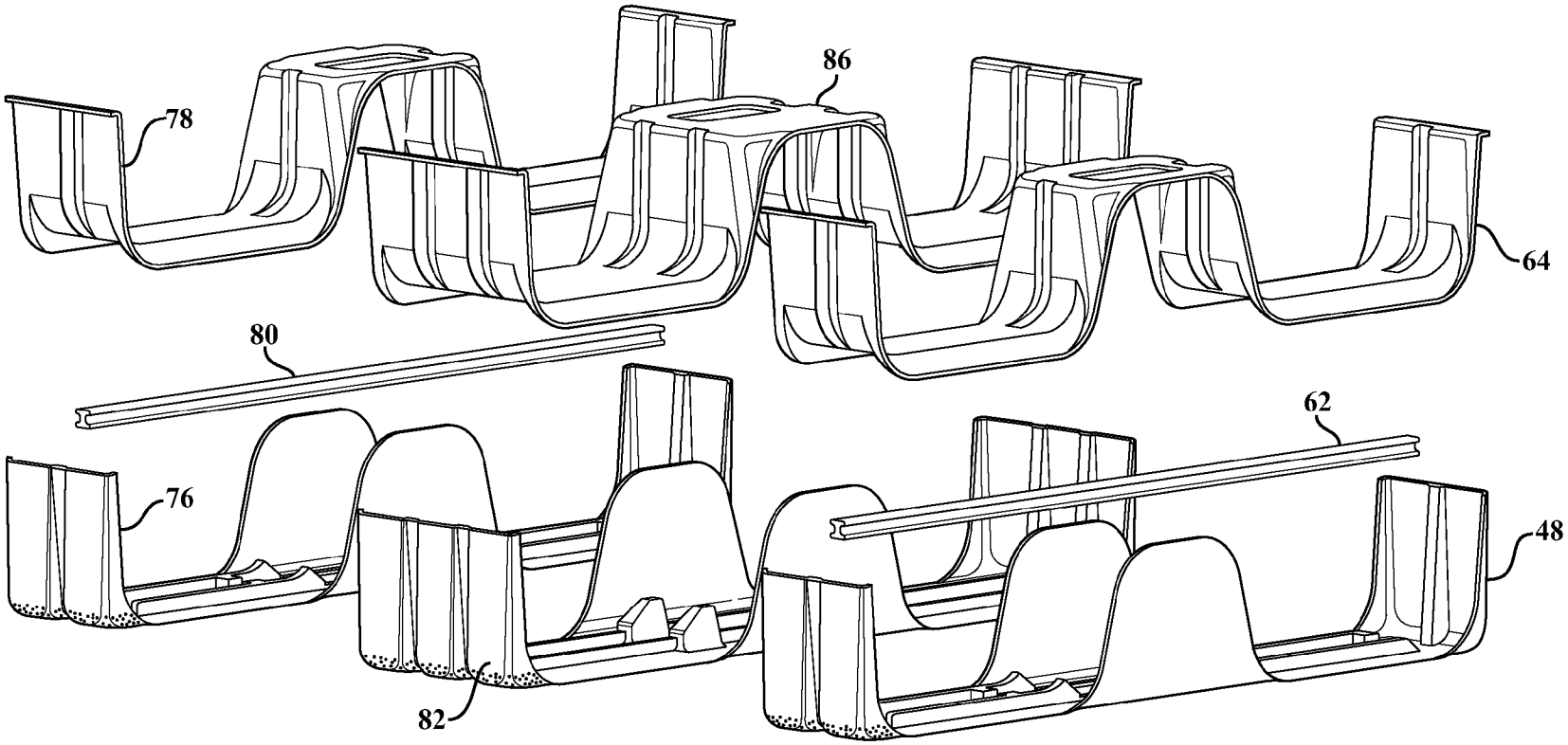
FIG. 6 is an exploded view of the three runner structures showing the twin-sheet constructions thereof and the use of reinforcing beams in two of the three runner structures.
Figure 7:
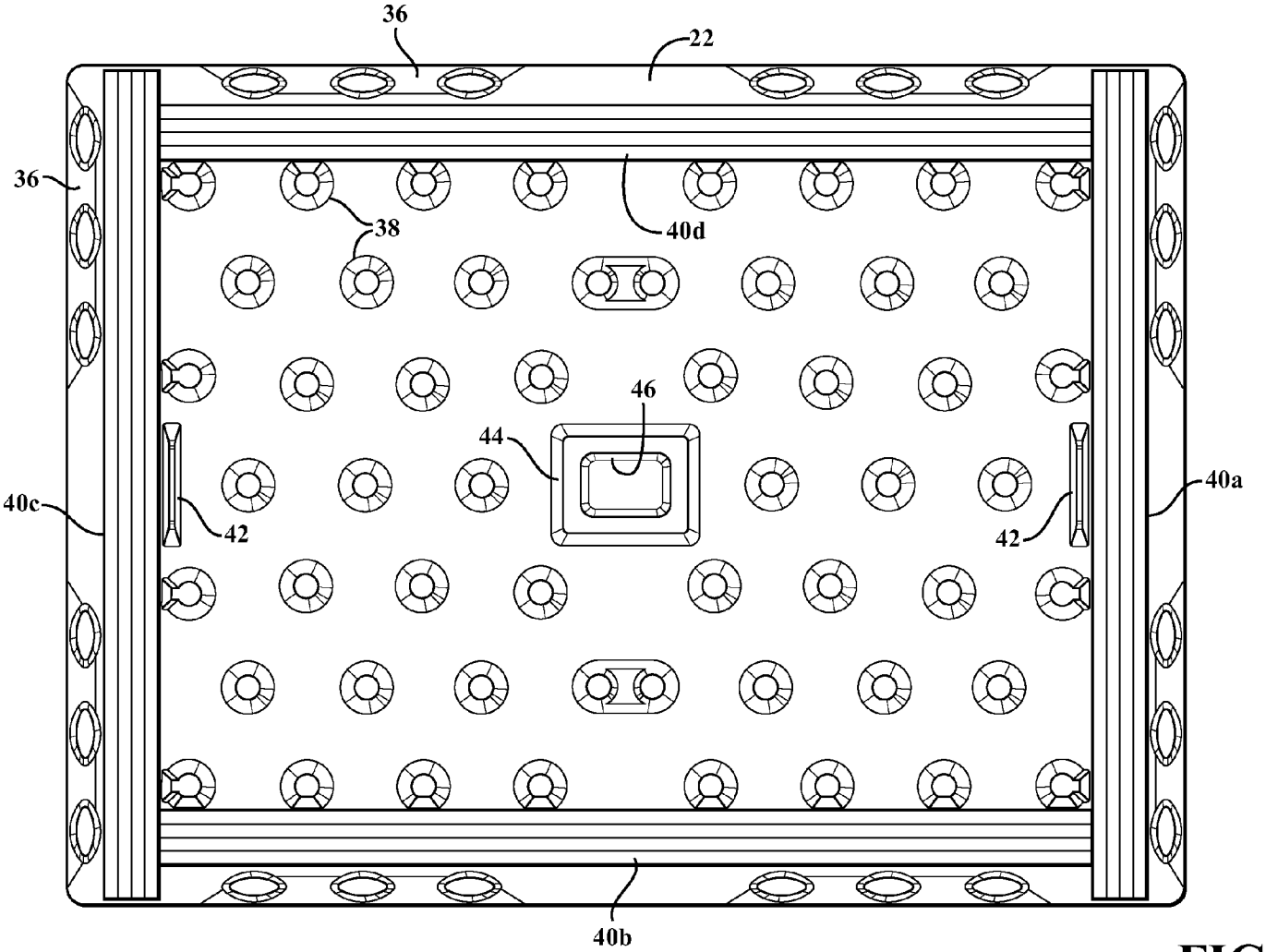
FIG. 7 is a top view of the bottom sheet of the twin-sheet deck structure showing the upper reinforcing frame.
Figure 8:
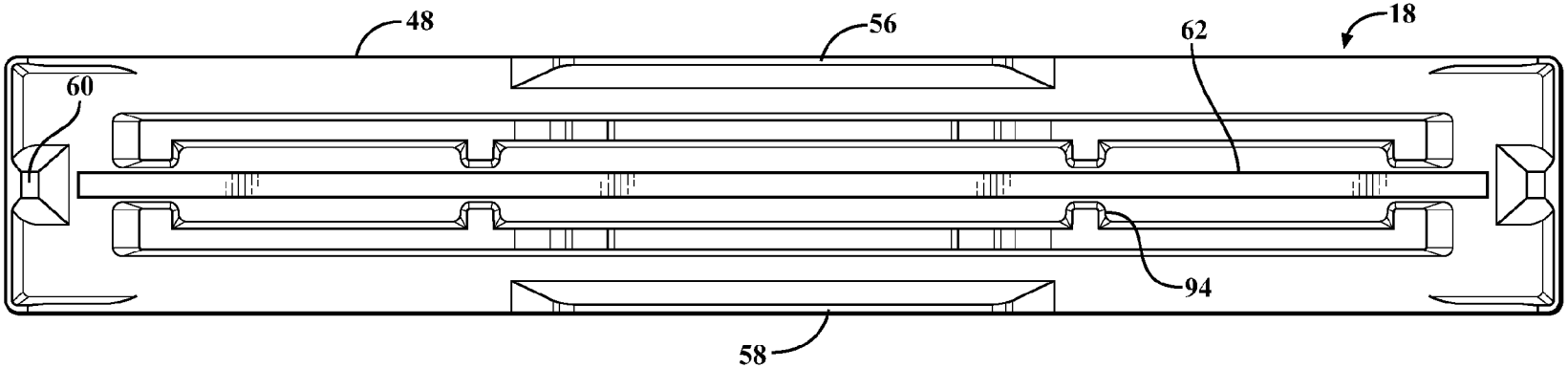
FIG. 8 is a top view of the bottom sheet of one of the runner structures.

The bottom sheet 22 of the deck structure 12, best shown in FIGS. 4, 5 and 7, is also generally rectangular in shape and is thermoformed to provide peripheral areas 34 in the corners which receive the landings of the corner steps formed in the upper sheet 20 as described above and, between these landings, upturned lips 36 which receive and are peripherally knit to peripheral flange of the upper sheet 20 when the two sheets are fused together. Accordingly, the knit seam around the entire pallet is an undulating one, lower at the steps and higher between them.

Figure 10:
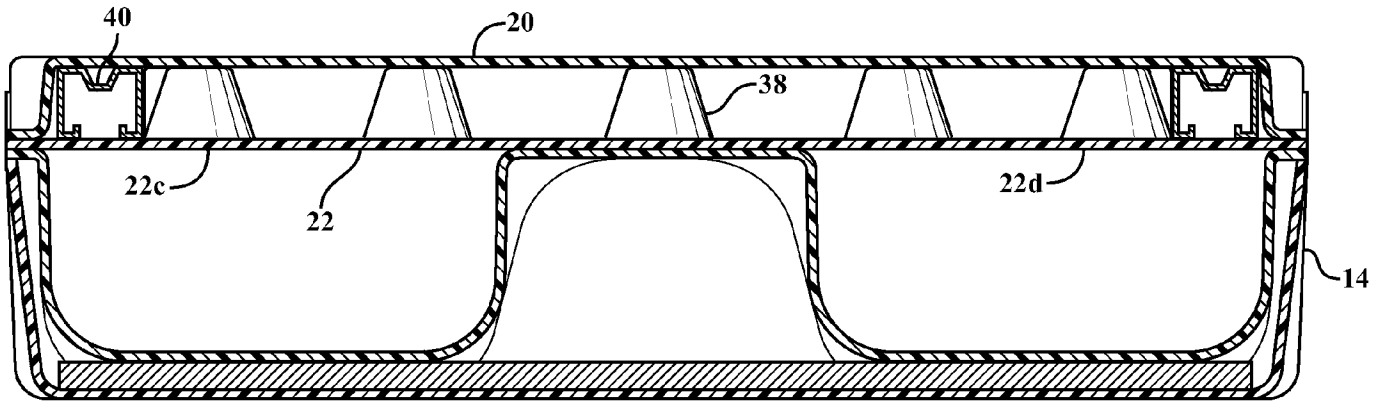
FIG. 10 is an end sectional view of the pallet of FIG. 1.

Additionally, the bottom sheet 22 has formed thereover, a plurality of upwardly extending knob-like spacers 38 which may be cylindrical or pyramidal or both, but generally have flat top surfaces. These spacers occupy the interior volume which is defined between the top deck sheet 20 and the bottom deck sheet 22 when the two are fused together. Spacers 38 provide substantial rigidity over the entire loading surface of the deck 12. The fusing process is such as to join or knit the top surfaces of the spacers 38 to the bottom surface of the top sheet 20 as shown in FIG. 10.

The spacers 38 are arranged in such a way as to provide room for a quadrangular channel which receives a quadrangular metal reinforcing frame 40 made up of four metal beams 40*a*, 40*b*, 40*c* and 40*d*, the geometrical arrangement being best shown in FIG. 7. The frame 40 is essentially encapsulated between the top and bottom sheets of the deck structure 12 in the fabrication process. The frame 40 may be made of steel, aluminum or any other suitable rigid material including composites. The cross-sections of the beams 40*a*, 40*b*, 40*c* and 40*d* are essentially "M" shaped but other configurations can also be used. This particular shape is readily commercially available as a roll-formed metal part in commercial lengths. The height of the beams is such as to correspond essentially to the height of the spacer knobs 38 so that the beams fit within the top and bottom sheets of the deck 12 without rattling or moving around. Additional upstanding features 42 may be molded into the bottom sheet to define the channel for the frame 40 and to hold the beams which make up the frame 40 in place.

It will be understood by those persons skilled in the thermoforming arts that the plastic materials which are most likely to be used to manufacture the deck sheets 20, 22 are fused or knitted together when hot and may shrink slightly during the cooling process. This shrinkage is such as to require the beams of the frame 40 to be initially arranged with some slight gaps between them; the shrinkage takes up these gaps and pulls the frame tightly together to form a well unified structure. It also causes the top sheet slots 32 to bear tightly against beams 40.

The bottom sheet 22 is also thermoformed so as to define a generally rectangular upstanding central tower 44 having a center recess 46. This tower 44 has a height which is essentially the same as the height of the spacers 38 and, as such, contacts and fuses to the bottom surface of the top sheet 20 in the joining process. The tower resists deflection of the load surface in the center of the deck.

Figure 3:
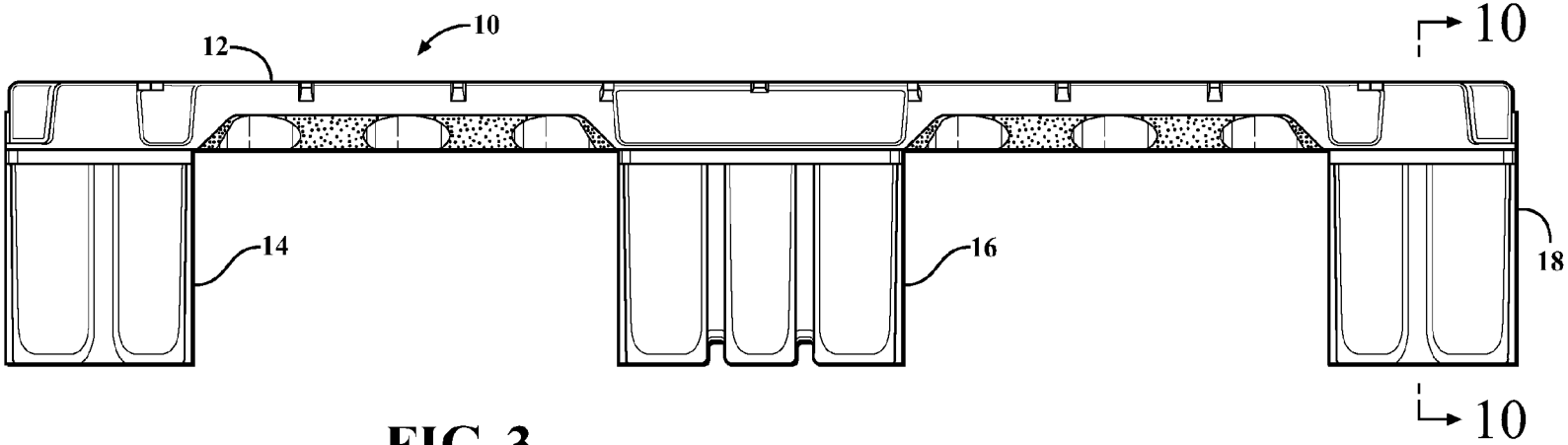
FIG. 3 is a side view of the plastic pallet of FIG. 1.

Turning now to the runner structures 14, 16, 18, it will be noted that the end runners 14, 18 are substantially identical in width and length whereas the center runner 16 is wider and, in this embodiment, unreinforced. This is essentially a design choice and all of the runners may optionally be of the same design. The spacing between the runner structures is best shown in FIG. 3 and defines two spaced-apart parallel forklift openings, the dimensions of which are such as to be compatible with commercially available forklift trucks around the world. The effective height of the forklift opening may be on the order of 80 to 100 mm and the spacing between the runner structures might be on the order of 150 to 200 mm. Again, these dimensions are given purely by way of example.

Continuing now with a more detailed description of the runner structures, runner structure 18 comprises a thermoformed bottom sheet or plate 48 having a generally rectangular flat sole portion 50 bounded by upturned vertical end structures 52, 54. Upstanding sidewalls 56, 58 are formed centrally between the end sections 52, 54. A groove 60 is formed in the each wall 52, 54 to provide a rib on the interior surface. These ribs match up with ribs 67 in the end walls of the top parts 64. Those ribs can be fused together where they meet and touch in the final fabrication process. Parallel ribs 94 formed on the inside of the plate 48 provide a place for a reinforcing beam 62 in the runner. Upper element 64 has raised sections 69, 71 complemental to the ribs 94.

The top sheet element 64 has a soft or undulating "W" shape with upstanding end walls 64, 66 and a raised center section 70 having a flat top surface 72 within which an opening 74 is formed. The top element 64 is fused to the bottom plate 48 with the pultruded rod 62 trapped between them. It will also be noted that the upstanding end walls 66, 68 have peripheral lips 73 which rest atop the peripheral surfaces 75 of the end walls 52, 54 and are knit to them in the joining or fusing process.

The other runner structure 14 comprises a bottom sheet 76 forming a sole plate and a top sheet 78 fused to the sole plate in a manner which is identical to the runner 18 and will not be described in detail because of this identity. The runner structure 14 also contains an encapsulated reinforcing beam 80 in the form of a composite pultrusion which rests within a track formed by the raised track wall structures 94 in the sole plate 76. Both runners 18 and 14 provide "footprints" corresponding to the shape and surface areas of the sole plate sheets 50 and 76.

The center runner structure 16, as stated above, is generally similar to the end runners 14, 18 but is wider and, because of this width, accommodate two grooves 84 in the end walls lower plate 82 as well as two complemental ribs 85 in the upper sheet 86. Top sheet 86 also has a soft "W" shape with end walls and a raised center structure 88 with a top surface 90 having a center opening 92. The ribs 85 in the top sheet 86 are also discontinuous as shown in FIG. 4. The sheets or components 82, 86 are knitted together by thermal fusing to form an undulating peripheral knit line which follows the shape of the periphery up and down the end walls and over the outer walls 56, 58.

Figure 9:
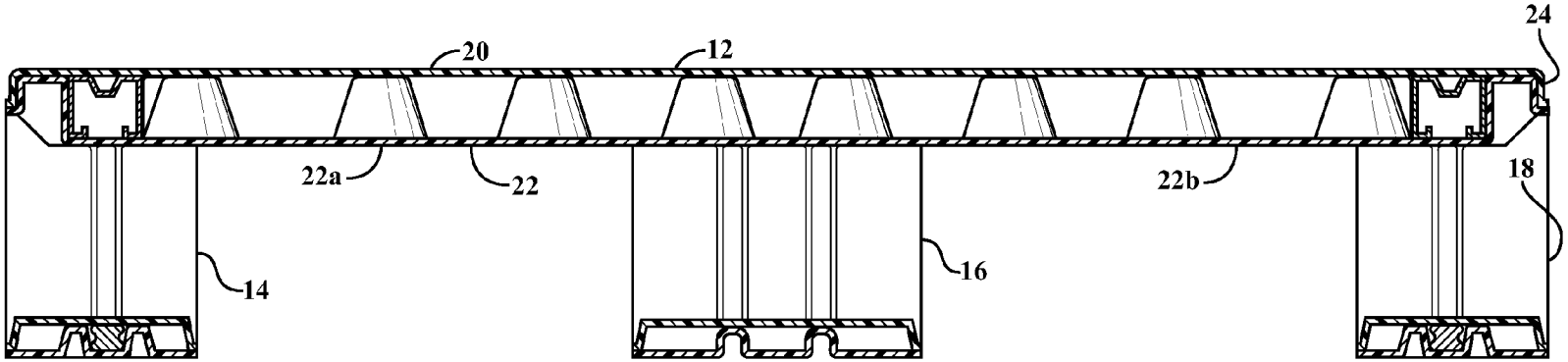
FIG. 9 is a side sectional view of the pallet of FIG. 1.

The final step in the fabrication of the pallet 10 is to fuse or join the three runner structures 14, 16, 18 to the bottom surface of the deck 12 as shown in FIGS. 1, 3 and 9.

Figure 2:
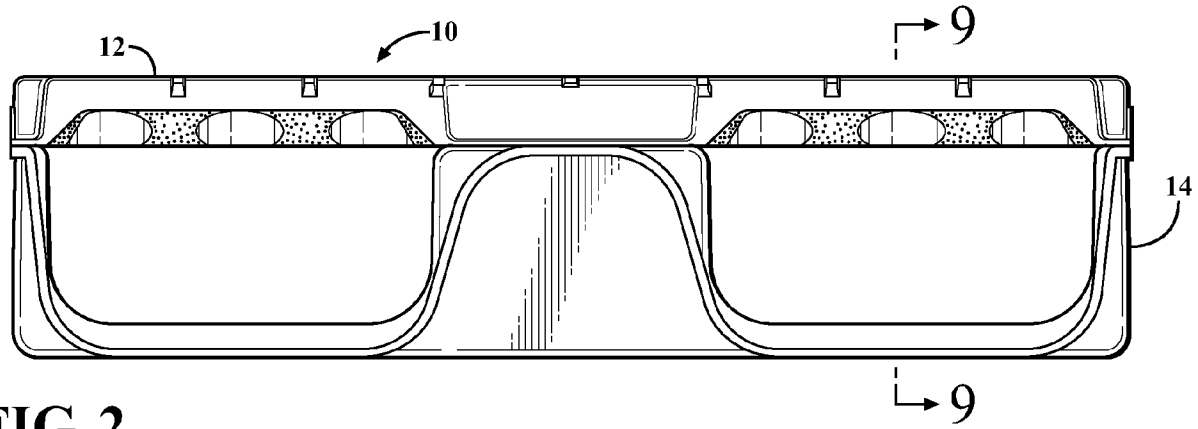
FIG. 2 is a end view of the plastic pallet of FIG. 1.

As indicated above, the pallet 10 is preferably constructed from co-extruded sheet material as to provide a high friction surface on the top or load surface of the deck 12 as well as on the exposed areas of the lower sheet of the deck 12 which form the top surfaces of the four forklift opening traces. It will be appreciated that one set of forklift openings is formed by the spacing between the runner structures 14, 16, 18 as shown in FIG. 3 and that another set of forklift openings is formed by the "W" shapes of the runner structures themselves, as shown in FIG. 2. In both cases, the top surfaces of the forklift openings are portions of the under surface of the sheet 22, two of these surfaces being identified by the reference characters 22*a* and 22*b* in FIG. 9 and the two remaining surfaces being identified by reference characters 22*c* and 22*d* in FIG. 10. These areas are also fabricated from a two-layer co-extruded sheet material to provide the high friction characteristic to prevent the pallet from slipping off of the forklift truck in use. However, the Vyron® layer is not added to surfaces where the runner structures 14, 16, 18 are joined to the deck 12 or on any of the surfaces of the deck 12 and runner structures 14, 16, 18 where the sheets which make up those structures are joined to one another.

The co-extrusion process extrudes a sheet of polymeric deck material, such as polyethylene, through one opening of a die and a layer of a rubber-polyolefin blend through a parallel opening and the two materials are merged or joined together to form a composite sheet. The die openings are, of course, geometrically sized and shaped to put the olefin surface material only where it is desired and avoid placing it where a fusing step is to be carried out later in the fabrication of the finished pallet. Other techniques may be used to increase surface friction as explained above.

Figure 11:
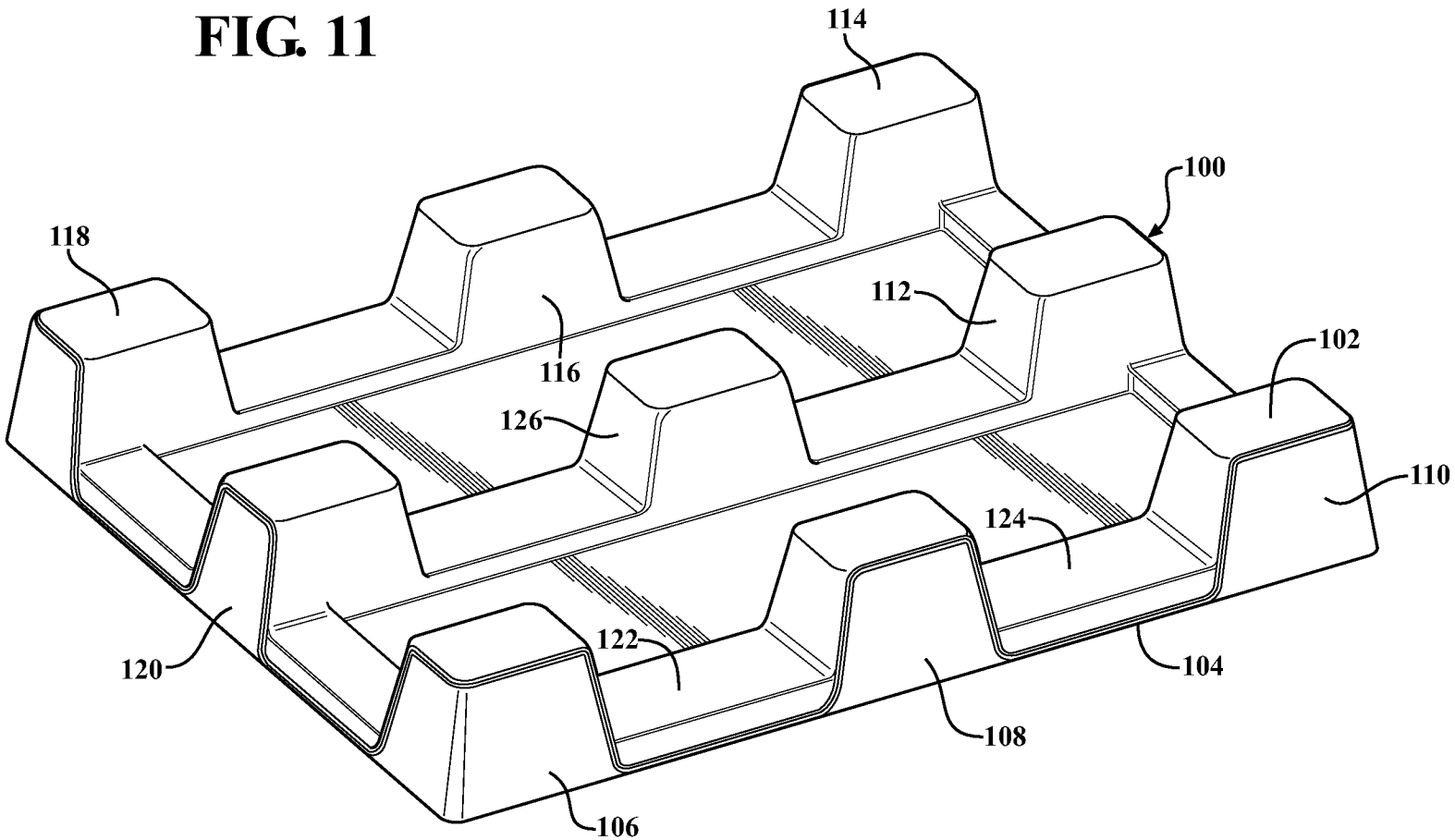
FIG. 11 is a perspective view of an alternative runner structure.

The runner structures 14, 16, 18, as best shown in FIG. 9, create three parallel spaced-apart footprints, the center footprint being somewhat larger in area than the footprints created by the runner structures 14, 18. As described above, the runner structures 14, 16, 18 are created as individual structures and then attached to the deck 12 in any of various conventional fashions, of which thermal fusing is preferred; i.e., it will be understood that separate adhesives and other more conventional fasteners can be used for this purpose. It is also possible to join the runner structures with additional peripheral structure to create a full quadrangular footprint as shown in FIG. 11. In this drawing, a twin-sheet runner structure 100 comprises thermoformed top and bottom sheets 102, 104 to form nine legs with flat top surfaces adapted to be fused to a twin-sheet deck as shown in FIGS. 4 and 5. The knit line undulates around the periphery of the structure 100 from near the tops of the legs 106, 108, 110, 112, 114, 116, 118 and 120 to the lower connector sections such as 122, 124 between the legs. Center leg 126 provides load support for the deck just as structure 88 does in the separate runner shown in FIG. 4. The runner structure of FIG. 11 also provides four-way forklift entry.

The gages of the plastic sheets may be selected to achieve desired weight targets as will be apparent to those skilled in the fabrication of plastic pallets and like articles.

The fabrication process for the pallet 10 may be essentially as follows: sheets of thermoformable polymeric material are extruded in the desired thickness and areas or cut from larger previously extruded sheets. The individual sheets 20, 22, 50, 64, 76, 78, 82 and 86 are all thermoformed into the shapes as generally shown. The reinforcing structures 40, 62 and 80 are put in place and the structures 12, 14, 16 and 18 are formed by fusing. Thereafter the runners 14, 16 and 18 or the structure 100 are joined to the deck 12. The olefin coating is created as described above or an alternative technique is used to rough-up the otherwise smooth, low friction polyethylene surface. A flame retardant may be added to the extruded plastic material prior to extrusion as desired or as required by local regulation or law.

What is claimed is:

1. A unitary forklift-compatible reinforced plastic pallet comprising:

A partly hollow thermoformed, twin sheet upper deck comprising peripherally fused together top and bottom sheets creating an interior volume and a reinforcement frame encapsulated between the top and bottom sheets within said volume; and a plurality of partly hollow thermoformed twin sheet runners formed independently of said deck each comprising a plate-like bottom sheet with upturned end walls and centrally-located opposed sidewalls spaced inwardly from end walls, each of said runners further comprising a top sheet peripherally fused to said bottom sheet including fused portions along the tops of said sidewalls and end walls; said top sheet being formed of an undulating configuration whereby the fused combination of the top and bottom sheets creates twin sheet upstanding hollow vertical end structures and, in combination with said sidewalls, a hollow center structure whereby forklift openings are formed in a first direction between said end structures and said center structure;

said runners being permanently fused to said upper deck at the tops of said end structures and said center structures in spaced-apart relationship to form a second set of forklift openings in a second direction at 90° to the first direction by the spacing between said fused runners.

2. A pallet as defined in claim 1 wherein an array of upstanding spacers are formed between the top and bottom deck sheets, which spacers occupy said interior volume and are fused in place.

3. A pallet as defined in claim 1 wherein said deck is generally rectangular and said top sheet has peripheral steps formed at the corners thereof; the underside of steps being fused to the bottom deck sheet.

4. A pallet as defined in claim 1 wherein said bottom deck sheet has a raised structure formed generally in the center thereof, said raised structure being fused to the underside of said top deck sheet.

5. A pallet as defined in claim 4 wherein said raised structure has a central recess formed in the top surface thereof.

6. A pallet as defined in claim 1 wherein said top runner sheet is formed in a "W" shape to nestingly and complementally fit together with a bottom runner sheet.

7. A pallet as defined in claim 6 wherein said top runner sheet has a raised central structure with a generally flat top, said raised central structure being geometrically complemental to said central side walls and peripherally fused thereto.

8. A pallet as defined in claim 1 wherein said fused together top and bottom runner sheets form an enclosed space there between, and an elongate reinforcing member disposed in said enclosed space in at least some of said runners.

9. A pallet as defined in claim 1 wherein the three runners comprise two outside runners and one center runner, the center runner being wider than the outside runners.

10. A pallet as defined in claim 6 wherein the bottom runner sheet has at least one longitudinal rib formed in the bottom inside surface thereof to at least partially define a longitudinal slot in the interior of each runner.

11. A pallet as defined in claim 10 wherein said slot accommodates a reinforcing member.

12. A pallet as defined in claim 1 wherein at least the top surface of said deck has an enhanced friction treatment.

13. A pallet as defined in claim 12 wherein at least part of the forklift openings have an enhanced friction surface treatment thereon.

14. A pallet as defined in claim 1 wherein said runners are separately formed from each other before being fused to said upper deck.

15. A pallet as defined in claim 1 wherein said runners further comprise additional structure co-joining the runners in an integral fashion.

16. A pallet as defined in claim 1 wherein the upper deck has a plurality of spaced steps arranged around the periphery thereof, said runner end wall surfaces having the top edges thereof fused to the undersides of selected ones of said steps.

17. A pallet with four-way forklift entry capability comprising:

a deck including top and bottom substantially co-extensive fused-together plastic sheets configured to provide a substantially flat uninterrupted loading surface, a central interior volume with an array of spacers therebetween, peripheral flanges defined at least in part by steps in the corners of the top sheet and in part by steps with mating surfaces between said corners, said top sheet being fused to a peripheral flange of the bottom sheet;

a rigid frame made up of one or more reinforcing beams disposed between the top and bottom deck sheets; and a plurality of separately formed and at least partly hollow, twin-sheet runner structures fused to the bottom sheet wherein each of said runner structures comprises first and second complementally thermoformed sheets of fused-together plastic configured to provide three parallel load-bearing runners providing footprints which are spaced apart to provide forklift entry openings therebetween wherein each of said runner structures comprises upturned hollow end structures with top edges, the top edges of said upstanding end structures being fused to the underside of said deck at said steps with mating surfaces.

18. A pallet as defined in claim 17 further including reinforcing members incorporated into at least some of said runner structures.

19. A forklift-compatible pallet comprising:

a deck comprising a generally planar top deck sheet of thermoformed plastic with recessed peripheral corner structures and, along each of two opposite sides, a recessed peripheral center structure;

said deck further comprising a bottom deck sheet of thermoformed plastic generally coextensive with a top deck sheet and having spacers arranged thereover;

a reinforcing frame;

said top and bottom deck sheets being fused together along the peripheries thereof as well as by said spacers with the reinforcing frame trapped therebetween;

said pallet further comprising three spaced-apart runner structures, each of which comprises peripherally fused-together thermoformed top and bottom runner members defining three distinct spaced-apart parallel footprints separated by two spaced-apart forklift openings wherein said runners are fused to said deck;

wherein each of said runner structures comprises a generally elongate and flat bottom plate having upturned end structures with top edges and centrally located opposed side wall structures spaced inwardly from said end wall structures to at least partially define forklift openings therebetween, said runner structures further comprising a thermoformed top member of an undulating "W" configuration including upstanding end walls and a raised center section wherein the top sheet is peripherally fused to the bottom plate along the length thereof as well as along the top edges of said upstanding end wall walls to form a partly hollow twin sheet structure which is thereafter fused to the underside of said deck.

20. The pallet of claim 19 wherein elongate reinforcing members are incorporated into at least two of said runner structures.

21. A pallet as defined in claim 12 wherein the enhanced friction treatment comprises a layer of high friction material coextruded onto said deck surface.

* * * * *